US005172445A

United States Patent [19]

Chandler

[11] Patent Number: 5,172,445

[45] Date of Patent: Dec. 22, 1992

[54] CLEANER DEVICE FOR SWIMMING POOLS AND THE LIKE

[75] Inventor: Michael J. Chandler, Eden Bridge, Great Britain

[73] Assignee: Jean-Pierre Orset, Saint-Denis, France; a part interest

[21] Appl. No.: 735,310

[22] Filed: Jul. 24, 1991

[30] Foreign Application Priority Data

Jul. 25, 1990 [FR] France ..... 90 09511

[51] Int. Cl.[5] ..... F04H 3/20

[52] U.S. Cl. ..... 15/1.7; 15/387

[58] Field of Search ..... 15/1.7, 387

[56] References Cited

U.S. PATENT DOCUMENTS 983,988 2/1911 Foster et al. ..... 15/387 X
3,229,315 1/1966 Watson ..... 15/1.7
4,449,265 5/1984 Hoy ..... 15/1.7
4,560,418 12/1985 Raubenheimer ..... 15/1.7
5,044,034 9/1991 Iannucci ..... 15/1.7

*Primary Examiner*—Edward L. Roberts
*Attorney, Agent, or Firm*—Pollock, VandeSande and Priddy

[57] ABSTRACT

A hydraulic cleaner device comprises a water pump for drawing water from a pool through a tube, an open bottom casing divided into two compartments by a partition wall delimiting an inlet for an axial turbine having a rotor that drives a shaft connected by a reducing and transmitting mechanism to a set of wheels supporting the casing and a brush sweeping unit for movement along the bottom of the pool. One of the compartments of the casing is placed downstream of the axial turbine and is connected to the tube leading to the pump. An immersed buoyancy member is connected to the casing.

26 Claims, 6 Drawing Sheets

CLEANER DEVICE FOR SWIMMING POOLS AND THE LIKE

FIELD AND PURPOSE OF THE INVENTION

The present invention relates to a new cleaner device for the cleaning of pools, and typically swimming pools. The cleaner device of the invention is arranged to move in an automatic manner on the bottom of the pool, ensuring thereby a permanent frictional sweeping of the pool at the same time as a permanent suction draws up the foulnesses removed from the bottom of the pool.

The invention has also for its purpose to provide:

a device working only by means for circulating the water drawn up by the pump of the treatment unit provided in the pool;

a device which can be made of plastics material, in particular by a molding process;

a device having elements which are all assembled by an encasing arrangement and mutually locked;

a device having elements which can be disconnected and then connected again.

PRIOR ART

The art is illustrated by the following references: U.S. Pat. No. 3,979,788 ; European patent 0,352,487 ; Swiss patent 648,893; U.S. Pat. Nos. 4,168,557; 4,722,110; and 3,676,884.

According to the invention, the hydraulic cleaner device for a swimming pool and the like in which a water pump is provided for drawing water from the pool through e tube, comprises a bottom opened casing that is divided into two compartments by a partition wall delimiting an inlet for an axial turbine having a rotor, this rotor driving a shaft connected by a reducing and transmitting mechanism to a set of wheels, these wheels being both mounted on one shaft supporting the casing on both sides of brushes, one of the two compartments of the casing being placed downstream of the axial turbine and being connected to the tube leading to said water pump, an immersed buoyancy member being connected to the casing so that this casing is maintained in a substantially vertical position.

Various other features of the invention will moreover be revealed from the following disclosure.

BRIEF DESCRIPTION OF THE DRAWINGS

Embodiments of the invention are shown, as non limitative examples, in the accompanying drawings, wherein.

DETAILED DESCRIPTION OF THE INVENTION

Figure 1:
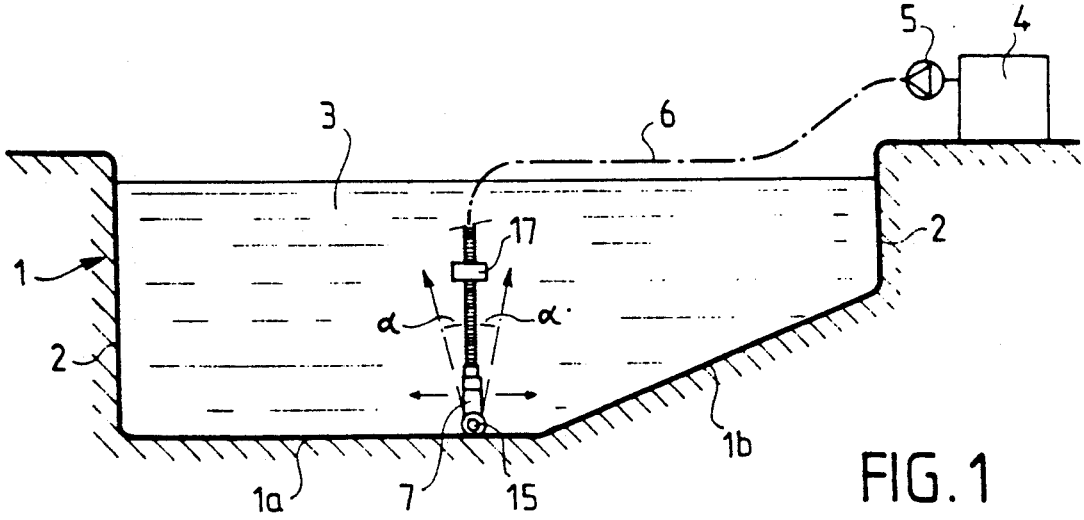
FIG. 1 is a diagrammatic cross-section of a pool comprising a cleaner device according to the invention.

FIG. 1 shows a pool 1, for example a swimming pool, having a bottom comprising a plane horizontal portion 1*a* and inclined portion 1*b*.

The plane portions 1*a* and 1*b* are both connected to substantially vertical walls 2.

For treating a water body 3, the pool 1 comprises a treating unit 4 which is of a conventional type well known in the water treating art. The treating unit 4 is in particular provided with a set of filters in which the water circulates under the action of at least one pump 5 to which the water is brought by a tube 6 connected to the cleaner device generally shown at 7.

The cleaner device 7 comprises a hollow casing 8 which is opened in its bottom part.

The casing 8 is connected to the tube 6 by means of an outlet nozzle 9 and a sleeve 10.

It is advantageous that the connection between the casing 8 and the tube 6 be made so that the casing 8 can freely rotate with respect to the tube 6, which tube 6 must besides be a flexible tube.

The above result can be obtained through various means and, for example, as shown in the drawings, the outer wall of the outlet nozzle 9 and the outer wall of the tube 6 can each be ringed, and the inner ends of the sleeve 10 can have a set of rings 11 and 12 entering grooves between the rings of the tube 6 and of the outlet nozzle 9. The sleeve 10 can therefore freely rotate, both with respect to the outlet nozzle 9 and with respect to the tube 6, which tube 6 can itself freely rotate with respect to the outlet nozzle 9.

The casing 8 delimits two greater sides 8*a*, 8*b* (see FIG. 4) connected by lateral sides 13*a*, 13*b*, which lateral sides 13*a*, 13*b* are themselves connected together by a so-called upper side 13.

The lateral sides 13*a*, 13*b* carry a shaft 14 for a set of wheels 15, 16 which protrude from the lateral sides 13*a*, 13*b* of the casing 8.

When the cleaner device 7 is operated, the casing 8 is maintained in a position for which it is substantially vertically placed or makes small angles $\alpha\alpha$ (FIG. 1), with $\alpha$ being 25°.

For maintaining the casing 8 in a substantially vertical position, there is provided a buoyancy member 17 which is preferably frictionally connected to the tube 6, but which could also be connected to the casing 8 or to the sleeve 10 by means other than the tube 6.

Figure 6:
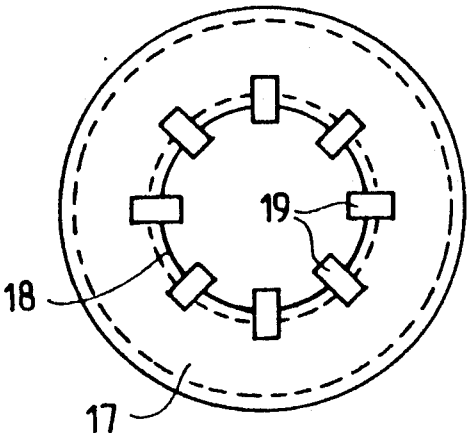
FIG. 6 is a diagrammatic plane view taken along line VI—VI of FIG. 2.

As better shown in FIG. 6, the buoyancy member 17 is made as an annular box having a central aperture 18 of a diameter slightly greater than that of the tube 6 and in which are protruding connecting means 19, for example lugs in a flexible material able to be introduced in the grooves of the annular tube 6 in order to frictionally lock the buoyancy member 17 on the tube 6 in a suitable place with respect to position of the casing 8.

The inside of the buoyancy member 17 is filled with a plastics material foam 20 (see FIG. 2), or a similar material. The above arrangement assures that the cleaner device can be maintained in a substantially vertical position even when it is moved on the inclined portion 1*b* of the bottom of the pool.

The inside of the casing 8 delimits a chamber divided into two compartments 21*a*, 21*b* by a partition wall 22.

Figure 2:
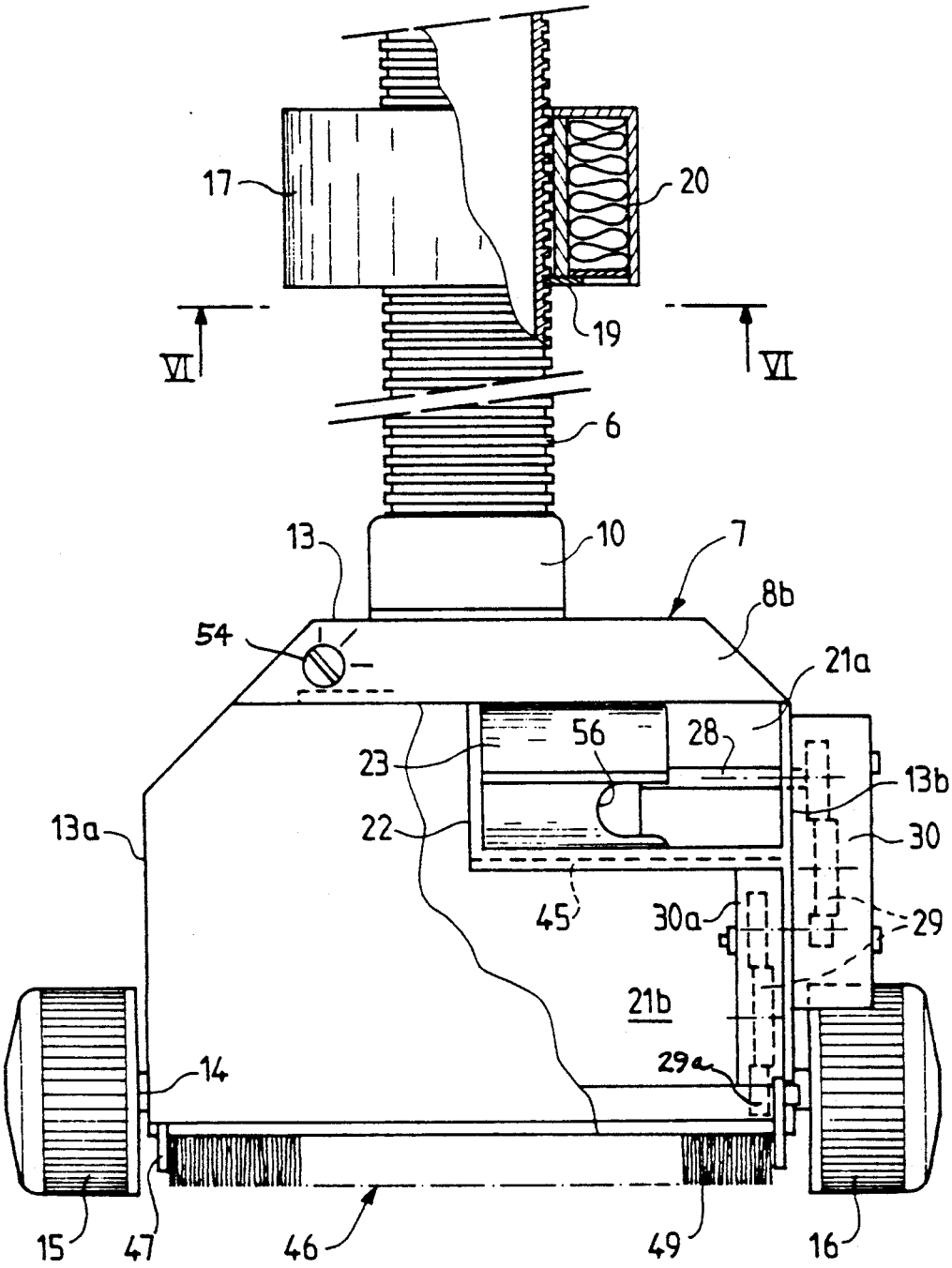
FIG. 2 is an elevation view, with part broken away, of the cleaner device shown in FIG. 1.
Figure 7:
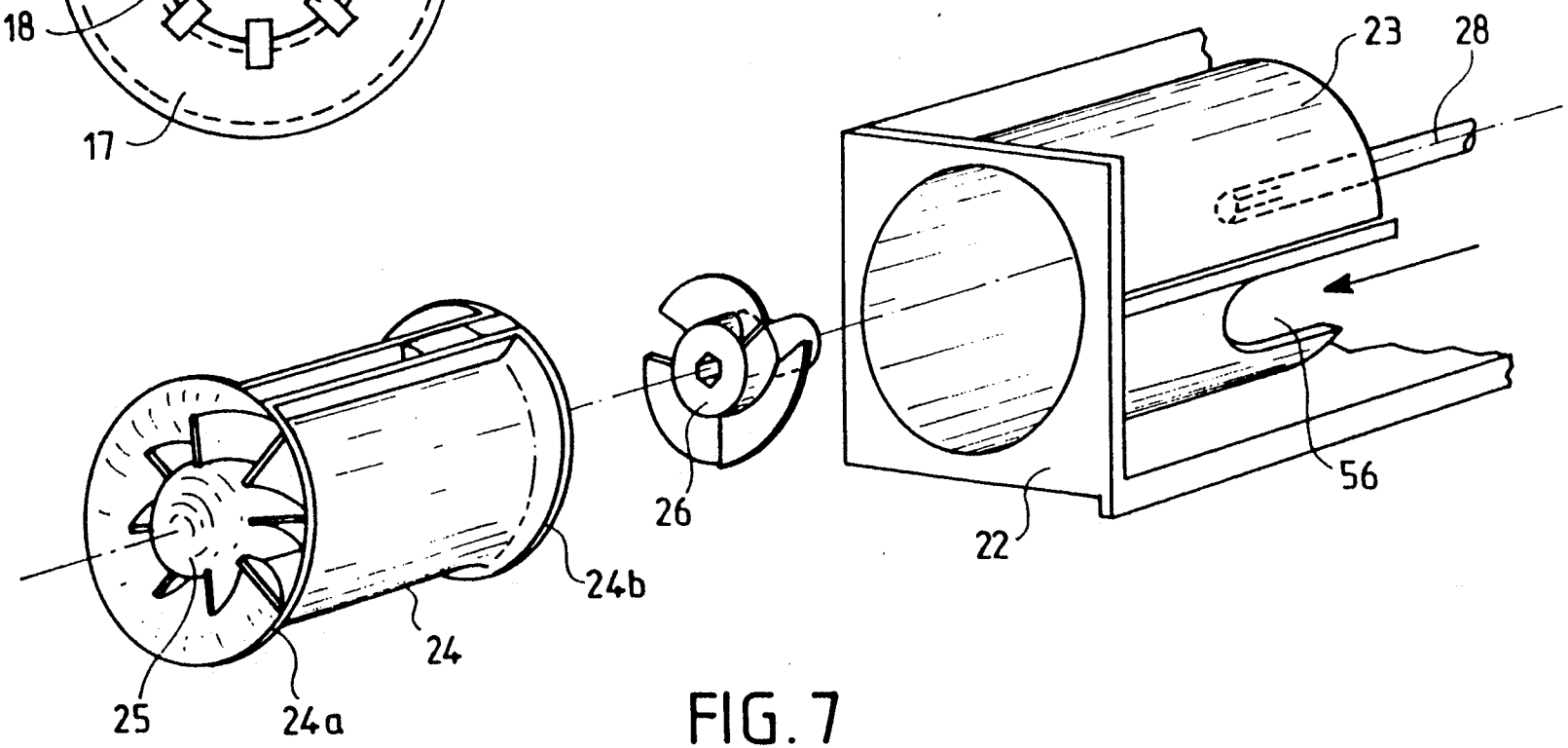
FIG. 7 is an enlarged broken perspective view illustrating a turbine assembly shown in particular in FIGS. 2 and 3.

FIGS. 2 and 7 show that the partition wall 22 forms a sheath 23 providing communication between the two compartments 21*a*, 21*b*. The sheath 23 contains a body 24 of a stator 25 of a turbine having a rotor 26 with an inlet which is thus formed by the opening of the sheath 23.

The body 24 has a shape of revolution and is terminated by rings 24*a*, 24*b* tightly engaged in the sheath 23 so to be blocked therein. The stator 25 comprises fixed directing blades 25*a* and contains an abutment bearing member 27 (FIG. 3) for the rotor 26.

The rotor 26 of the turbine, which is of an axial type, is carried by a shaft 28 on which rotor 26 is angularly keyed.

Practically, it is advantageous that the stator 25, like the rotor 26, be made of plastics material, while the shaft 28 and the abutment bearing member 27, are preferably made of metal. The bearing member 27 is inserted in the stator 25 to be protected thereby from impurities that are able to cross through the turbine upon working of the cleaner device.

The hereabove described mounting arrangement results in the rotor 26 being centered by the stator 25 which is itself centered in the sheath 23. A perfectly regular working is therefore obtained, even when the shaft 28 is made of a plastics material, for example a polyamide material having some flexibility for compensating possible minor alignment defects. It is also possible for the shaft 28 to be made of stainless steel.

The drawings, in particular FIG. 2, show that the shaft 28 drives a reducing and transmitting mechanism 29 having an outlet gear 29*a* which is operatively connected to the shaft 14, which shaft 14 will then drive the wheels 15, 16.

It is advantageous, as shown in the drawings, that the reducing mechanism 29 is placed in housings 30, 30*a* added on the lateral side 13*b* of the casing 8, for example by means of screws 31 which can, as the other part of the device, be made of plastics material.

Figure 3:
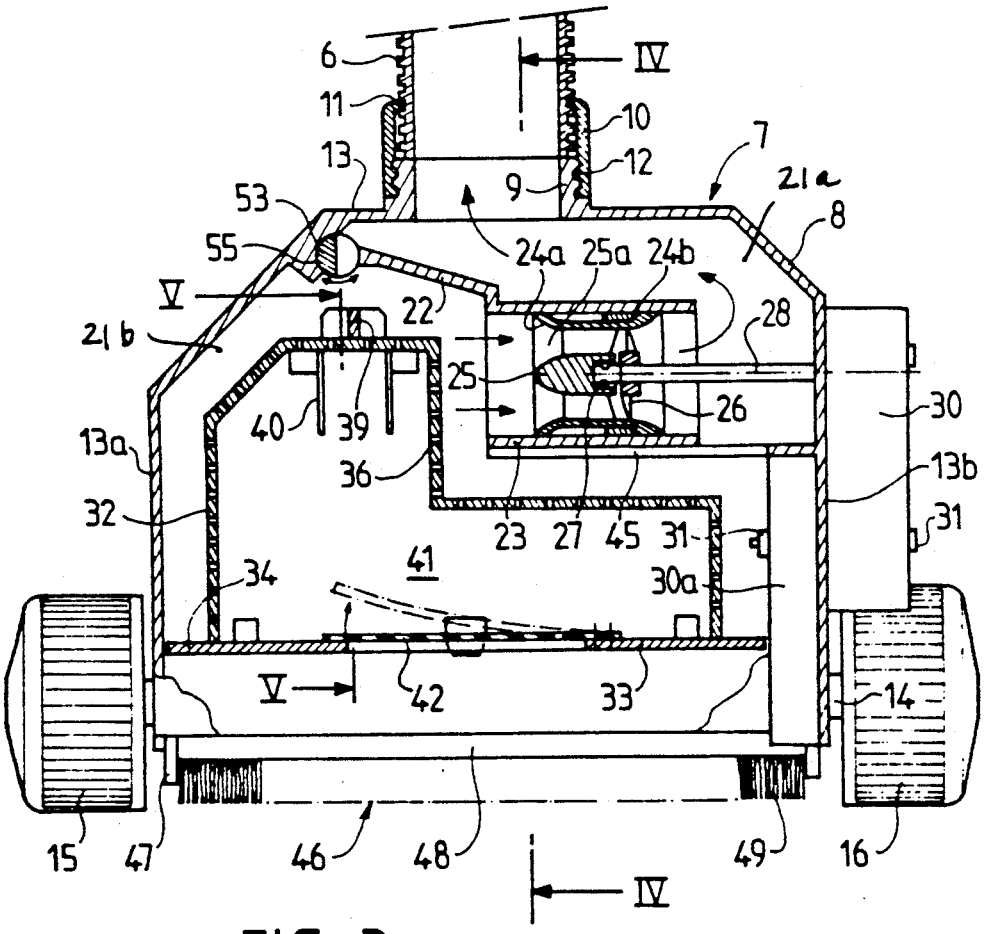
FIG. 3 is a cross-section corresponding to FIG. 2 and taken along line III—III of FIG. 4.

The compartment 21*b* of the chamber 21 contains a strainer 32 having an anterior surface 33 which completely closes the free side of the casing 8, by extending 33 from the lateral side 13*a* of the casing 8 to the lateral side 13*b* thereof and corresponding in shape to the casing 30*a*, which is shown in FIG. 3.

The anterior surface 33 of the strainer 32 is formed from a plate 34, which plate 34 forms a cover for closing the compartment 21*b*.

The plate 34 and the anterior surface 33 are formed as a unitary part with a perforated partition wall 36 so shaped for approximately fitting the sides of the casing 8 and of the partition wall 22 delimiting the compartment 21*b*.

Figure 5:
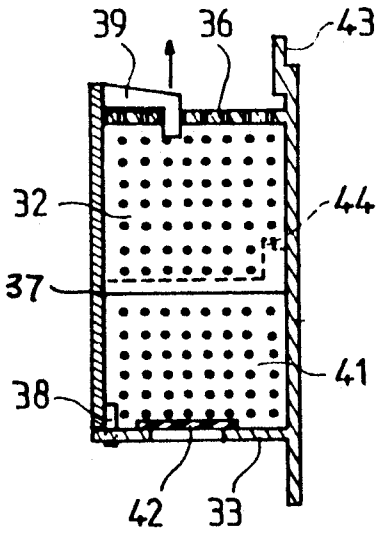
FIG. 5 is a cross-section taken along line V—V of FIG. 3 and illustrating a particular embodiment of a strainer provided in the device.

As better shown in FIG. 5, the perforated partition wall 36 is connected, together with the front surface 33, to a removable bottom member 37.

The removable bottom member 37 is formed by a plate provided with fingers 38 engaged in hollows of the anterior surface 33, the removable bottom member 37 being maintained in the perforated partition wall 36 by means of a lug 39 forming a locking element.

For facilitating a positioning and withdrawal of the lug 39, and, consequently, for facilitating assembling and disassembling of the removable bottom member 37, it is advantageous, on the one hand, that the lug 39 is flexible and, on the other hand, that slots 40 (FIG. 3) are provided in the perforated partition wall 36 in order that the partition wall 36 is itself resiliently deformable.

The preceding disclosure shows that the strainer 32 delimits an inner cavity 41 which communicates with the compartment 21*b* through perforations in the perforated partition wall 36.

The inner cavity 41 communicates moreover with the outside of the cleaner device 7 by means of a flap valve 42 carried by the anterior surface 33, the flap valve 42 being for example made as a resilient blade in an elastomeric material or the like.

Figure 4A:
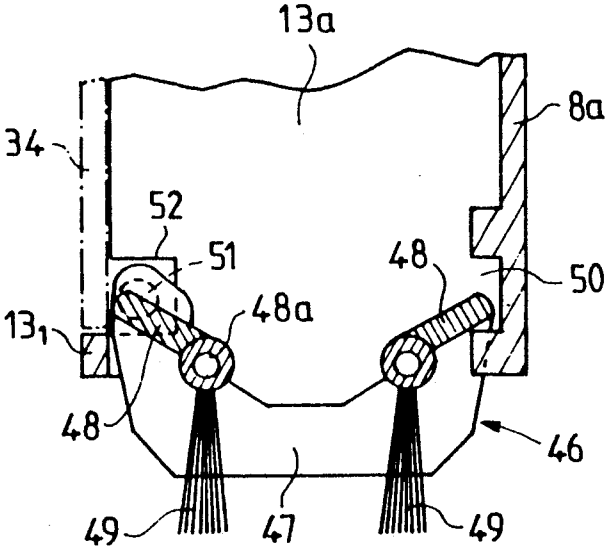
FIG. 4*a* is an enlarged partial cross-section of a detail of the embodiment shown in FIG. 4.
Figure 4:
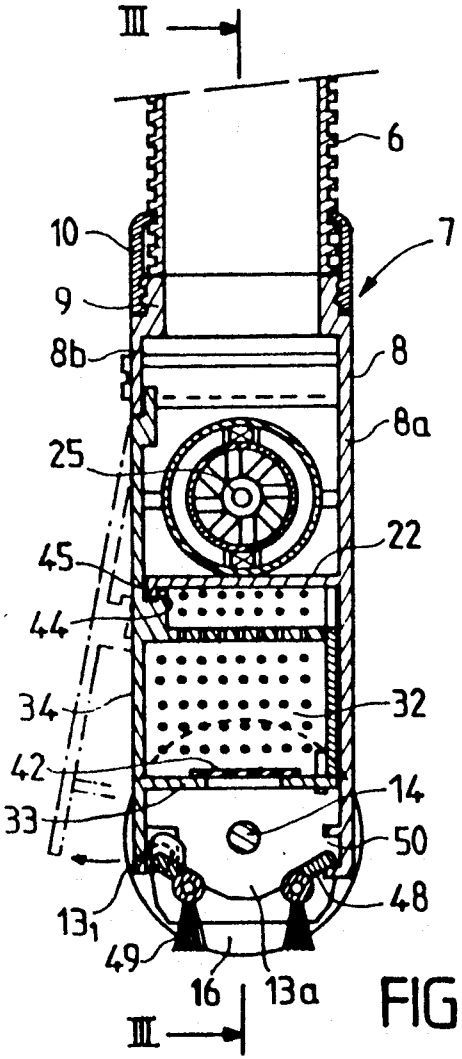
FIG. 4 is a cross-section taken along line IV—IV of FIG. 3.

As shown the strainer 32 is entirely carried by the cover forming plate 34, and the plate 34 is provided with steps 43 and 44 (FIGS. 4 and 5).

The steps 44 are provided to be engaged beneath the greater side 8*b* of the casing 8 (FIG. 2), while the step 43 is provided to be engaged beneath a strip 45 protruding from the partition wall 22, which is particularly shown in FIG. 4 which shows, like FIG. 4*a*, that the cover forming plate 34 comes into abutment against the protruding end $13_1$ of the lateral sides 13*a*, 13*b* when the cover forming plate 34 is in place.

The device is further provided, at its lower part, with a sweeping unit 46.

In the example as shown, the sweeping unit 46 comprises two cross members 47 connected together by small rods 48, preferably ballasted as shown at 48*a* in FIG. 4*a*.

The small rods 48 are provided with brushes 49 carried thereby.

One of the small rods 48 is engaged in a notch 50 of the greater side 8*a* of the casing 8. The other small rod 48 is provided with fingers 51 engaged in notches 52 of the lateral sides 13*a*, 13*b* of the casing 8 in order to be lockingly maintained by the cover forming plate 34 when the same is in position.

As shown in particular in FIG. 4*a*, the width of the notches 50 and 52 is substantially greater than the corresponding part of the small rods 48 and fingers 51, so that the sweeping unit 46 is loosely mounted to be movable with a relatively great magnitude, for example up to 5 mm with respect to the casing 8.

The length of the brushes 49 is chosen taking into account the position of the wheels 15, 16 so that one of the two wheels 15, 16 is always bearing on the bottom of the pool regardless of the angular position occupied by the cleaner device 7 with respect to the horizontal portion 1*a* or inclined portion 1*b* of the pool 1.

The device also comprises a regulating valve 53 (FIG. 3) which can be manually controlled from a head 54 (FIG. 2) for forming a possible bypass passage between the compartments 21*a*, 21*b* of the casing 8.

FIG. 3 shows that the adjusting valve 53 is formed by a key positioned in a housing 55 of the partition wall 22.

By more or less rotating the head 54, it is possible to control a passage from one to the of the compartments 21*a*, 21*b*, which control is made in dependency of the vacuum produced by the pump 5 of the treating unit 4.

The cleaner device as above described works in the following way:

When the pump 5 is working, water is drawn by the tube 6, which produces a vacuum in the compartment 21*a* of the casing 8.

Water is consequently drawn for being forced back in the treating unit 4 and then returned into the pool 1 in a conventional manner.

The casing 8 is open only at its lower part between the brushes 49, i.e. by the space remaining free between the small rods 48.

Water of the pool can be drawn only by raising the flap valve 42, through which the water enters the inner cavity 41 of the strainer 32.

Impurities are maintained in the cavity 41, water crossing through the perforated partition wall 36 and being therefore conducted to the inlet of the above-mentioned turbine, and thus to the directing blades 25*a* of the stator 25 of the turbine.

The circulating water rotates the turbine rotor 26, and the water is then brought from the compartment 21*a* to the outlet nozzle 9, to the tube 6, to the pump 5 and to the treating unit 4.

Rotation of the turbine rotor 26 has for its effect to rotate the shaft 28 the rotation of which is submitted to the reducing and transmitting mechanism 29 which rotates the outlet gear 29*a* and consequently the shaft 14 and wheels 15, 16.

Rotation of the wheels 15, 16 moves the cleaner device 7 as a whole on the bottom part of the pool with, one at least of the brushes 49 of the sweeping device 46 rubbing the bottom part of the pool and removing consequently therefrom impurities which as mentioned above are drawn and retained in the cavity 41 of the strainer 32.

The ballast 48*a* provided on the small rods 48 will ensure a suitable application of the brushes 49 on the ground of the pool, and this is provided without resulting in adhesion losses of the wheels 15, 16 on the bottom of the pool since the sweeping unit 46 can play with some clearance with respect to the casing 8 to which it is connected by the small rods 48 and the walls of the notches 50 and 52.

After a long use of the cleaner device 7, the sweeping device 46 can easily be cleaned by taking it cut from the pool 1 and dismantling it.

As shown in FIG. 4, it is first necessary to slightly raise the cover forming plate 34 so that it will escape from the protruding end $13_1$ of the lateral sides 13*a*, 13*b*.

Then the steps 44 are respectively removed from the strip 45 and from the greater side 8*b*, which makes possible to pivot as a whole the strainer as shown in FIG. 4 for removing it from the compartment 21*b*.

For cleaning the strainer 32, a pull is exerted on the lock forming lug 39 at the same time that a slight push is exerted on the wall of the strainer 32 in order to resiliently deform it because of the slots 40.

When the lug 39 is removed, the fingers 38 can be extracted so that the bottom member 37 is removed, and the impurities retained within the strainer 32 can be evacuated.

For dismounting the sweeping unit 46 after having removed the strainer 32, it suffices to slide the fingers 51 out of the notches 52, which makes the small rod 48 escape from the notch 50.

After having removed the strainer 32, the turbine as a whole can be dismantled by exerting a push on the turbine rotor 26, for example by acting with a finger of the user's band in direction of the arrow in FIG. 7.

The above push, which is facilitated by a notch 56 provided in the sheath 23, is transmitted to the turbine body 24 which slides toward the compartment 21*b* at the same time as the turbine rotor 26 is disengaged from the shaft 28.

After cleaning, the parts are again positioned by processing in a manner opposite to that described above, these parts being mutually locked together.

Figure 8:
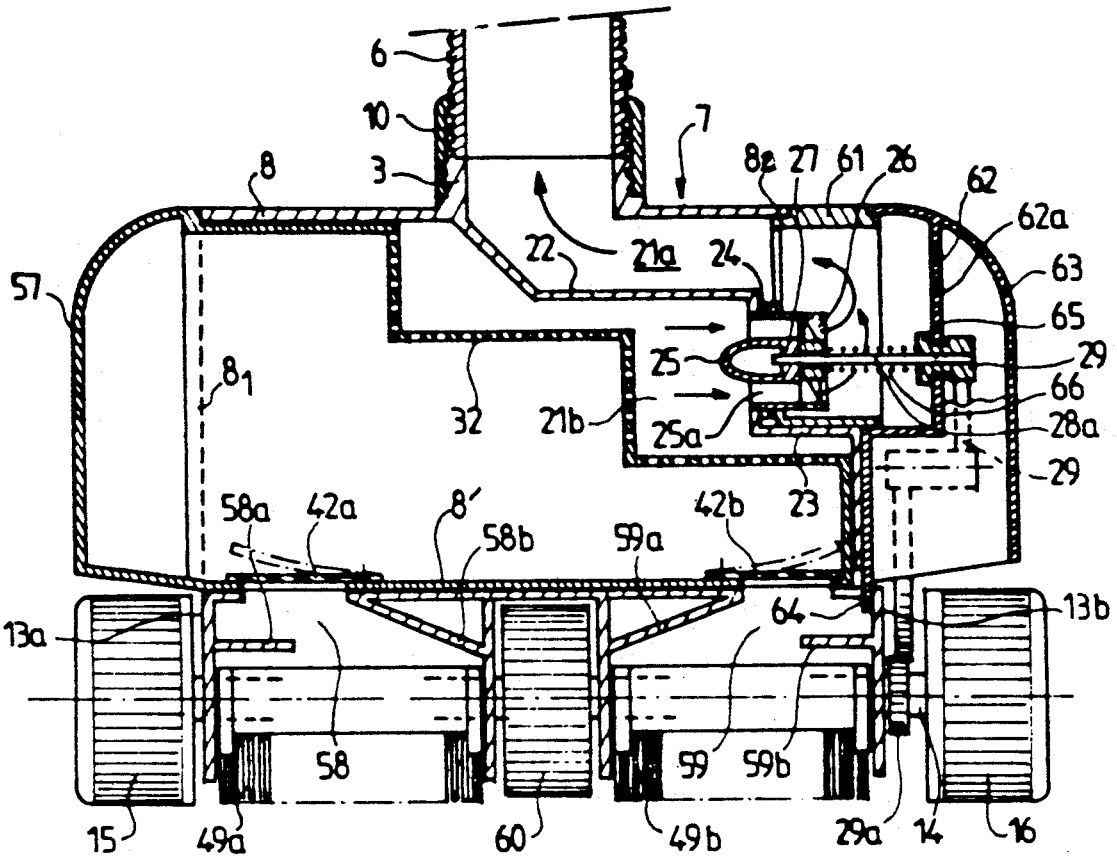
FIG. 8 is a cross-section similar to FIG. 2 of a variant of embodiment.
Figure 9:
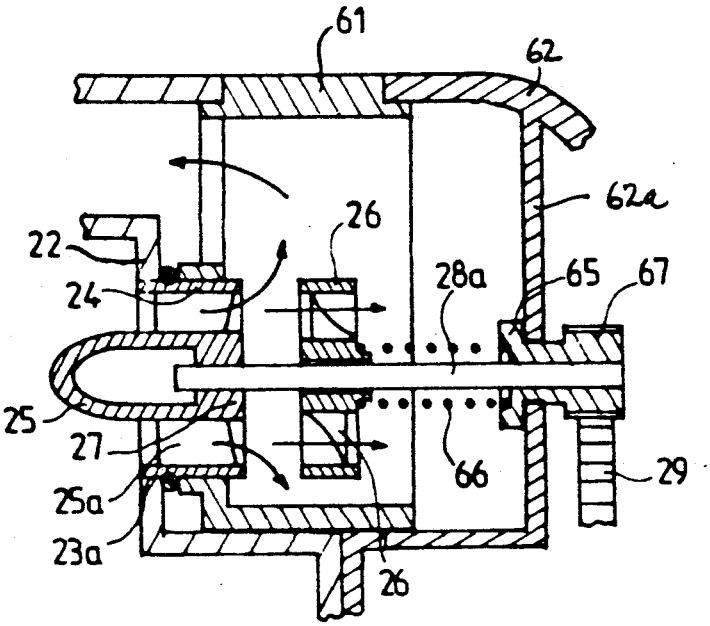
FIG. 9 is an enlarged partial cross-section of a part of the device in a characteristic position.

In a variant embodiment shown in FIGS. 8 and 9, the same reference numerals designate the same members as in FIGS. 1–7.

In FIG. 8, the casing 8 is open on each of its two lateral sides $8_1$, $8_2$.

On the lateral side $8_1$, the casing 8 receives a cover 57 fixed by an encasing arrangement and retained by a snap-in engagement, a friction engagement, or any other suitable known in the art. The cover 57 supports the strainer 32 which is merely encased within the casing 8, and the perforated part of which is shaped to fit the inner shape of the casing 8 and partition wall 22.

In the example as shown, the strainer 32 is also encased in the cover 57, and this strainer does not have a bottom part.

In this embodiment, the casing 8 comprises a bottom part 8' which is provided with two flap valves 42*a*, 42*b* placed opposite inlet ducts 58, 59 formed by baffle members 58*a*, 58*b* and 59*a*, 59*b* of the casing 8. The inlet ducts 58, 59 are placed above two sets of brushes 49*a*, 49*b* made as described with reference to the preceding figures concerning the brush 49, or according to another structure well known in the art.

The above arrangement enables a median wheel 60 to be mounted on the shaft 14 carrying the set of wheels 15, 16.

Preferably and as shown, the central wheel 60 has a diameter which is slightly smaller than that of the outer wheels 15, 16. This arrangement provides that the wheel 60 will not constantly bear on the bottom of the pool, but if an obstacle, for example an evevenness protruding from the bottom part of the pool, is found on the path of the small rods 49*a*, 49*b*, then the wheel 60 striking such an obstacle can rotate on the obstacle, driving the whole cleaner device which could otherwise be blocked if one of the wheels 15 or 16 was raised, and if this wheel is precisely a driving wheel.

The open lateral side $8_2$ of the casing 8 receives, by an encasing arrangement a sleeve 61 which is itself encased in a housing 62 formed by a cover 63 which is, on the one band, encased on the sleeve 61 and, on the other hand, connected to the casing 8 by means of lugs 64 or the like.

The sleeve 61 is also encased in the sheath 23 formed by the partition wall 22. The sheath 23 and the sleeve 61 support the body 24 containing the stator 25 and the directing blades 25*a* for directing the water rotating the rotor 26 of the axial turbine.

In this embodiment, the rotor 26 of the axial turbine is carried by a shaft 28*a* with respect to which it can rotate and freely slide, contrarily to what has been above described with reference to the shaft 28 in preceding figures.

The shaft 28*a* carries a sleeve 65 rigidly connected therewith so that the sleeve 65 is fixed in rotation with the shaft 28*a*, and a helical spring 66 is placed between the sleeve 65 and the rotor 26 of the axial turbine.

The rotation direction of the rotor 26 and the winding direction of the helical spring 66 are preferably the same.

The helical spring 66 exerts on the rotor 26 of the axial turbine, a push tending to maintain the axial turbine on the abutment bearing member 27 (FIG. 9).

The sleeve 65, which crosses through the bottom part 62*a* of the housing 62, is connected by a gear 67 to the above described reducing mechanism 29 rotatively connected to the wheels 15, 16.

The above disclosure shows that the members forming the sleeve 61, body 24, turbine 25, 26 and cover 63 which contains the reducing mechanism 29 form a unit which can easily be assembled and disassembled and which is, consequently, interchangeable. Moreover, this unit can itself be easily taken to pieces since the sleeve 61 is encased in the cover 63 which provides an easy possible cleaning of the rotor of the axial turbine 26 and of the blades 25*a* of the stator 25, as well as of other parts of the unit as, for example the spring 66.

Working of the embodiment according to FIGS. 8 and 9 is the same as that described in reference to FIGS. 1–7, except however that the aspiration tube 6 can be connected onto pumps 5 of different sizes without it being necessary to make any manual adjustment of the device as that provided by the regulating valve 53 of the preceding embodiment.

Actually when, say, the aspiration power of the pumps 5 is low, water having crossed through the strainer 32 passes between the directing blades 25*a* and then rotatively drives the axial turbine rotor 26 which directly transmits the rotation movement through the spring 66 to the sleeve 65 and consequently to the reducing mechanism 29, so that the shaft 14 of the wheels 15, 16 and 60 is rotatively driven.

If the aspiration rate of water through the tube 6 increases, typically when the pump 5 is more powerful, then the water flow which is directed toward the axial turbine has a tendency to drive the rotor 26 at a greater speed, but it also exerts a greater pressure on the blades of the rotor.

If the water pressure is greater than the force for which the axial turbine is applied against the abutment member 27 by means of the spring 66, the spring 66 is compressed and therefore the rotor 26 of the axial turbine is moved away from the abutment bearing member 27, so that a by-pass effect is produced and some water will escape radially between the stator formed by the directing blades 25*a* and the rotor 26, which bypass effect is shown by arcuate arrows in FIG. 9.

The higher is the pressure, the greater is the by-pass space provided between the stator and the rotor, and, as a result, the speed of the rotor 26 is thus maintained substantially constant and therefore the moving speed of the cleaner device on the bottom of the pool is also substantially constant and does not depend upon the power of the pump 5.

Figure 10:
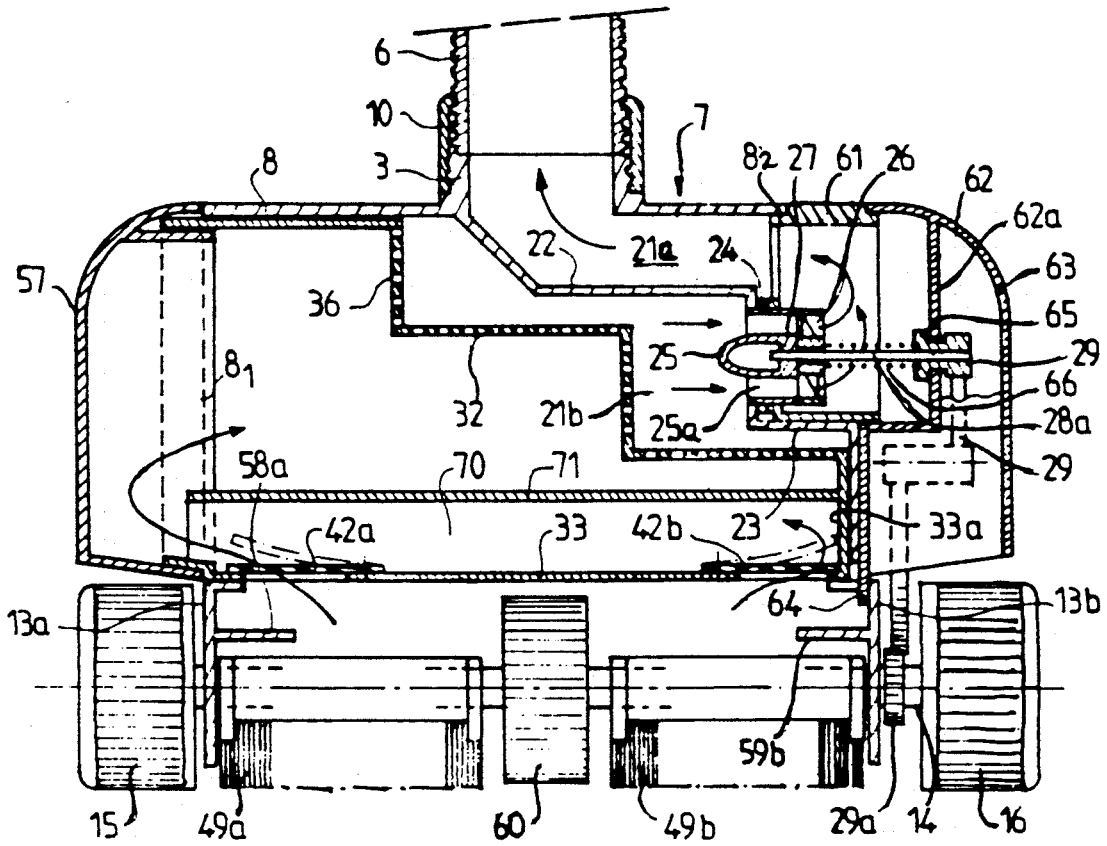
FIG. 10 is a cross-section similar to FIG. 3 of a variant.

According to the variant of FIG. 10, the strainer 32 comprises an unperforated bottom surface 33 which closes the free side of the casing 8 as in FIG. 3.

The strainer 32 is shaped to delimit an inside channel 70 which preferably is delimited by a U-shaped partition 71 formed in one piece with the bottom surface 33 and the rear wall 33*a* of the strainer.

The channel 70 is open at its end opposite to the rear wall 33*a* to communicate with the inside of the cover 57 and the inside of the strainer.

Bottom surface 33 is provided with flap valves 42*a*, 42*b* similar to those shown in FIG. 8 and hereabove described, which flap valves open in said channel 70.

The strainer 32 is open on its lateral side which correspond to the lateral side $8_1$ of the casing 8 into which it is fitted and retained by friction or snap connection or another dismantable means of the art.

In the embodiment of FIG. 10, when a suction effect is provided by the pump 5 through the tube 6, a flow of water is sucked through the flap valves 42*a*, 42*b* and the channel 70 according to the arrows; water then passes in the cover 57 toward the compartment 21*b* and the inside of the strainer 32, and to the compartment 21*a* to reach the tube 6.

For cleaning the entire device, the cover 57 is removed and the strainer extracted from the casing 8 to be washed.

The invention is not restricted to the embodiments shown and described in detail since various modifications thereof can be effected without departing from its scope as shown in the dependent claims. In particular the reducing and transmitting mechanism 29 can be provided with a run inverting device operated when the casing 8 strikes on an obstacle or as a function of another parameter. Samely, one of the wheels 15 or 16 can be driven through a free wheel or a torque limiter for enabling the casing 8 to pivot when it strikes an obstacle. Free wheel mechanisms, as well as run inverting mechanisms being well known, it has not be found useful to show them or to describe them in detail.

I claim:

1. A hydraulic cleaner device for a swimming pool and the like in which a water pump is provided for drawing water from the pool through a tube, said cleaner device comprising a casing having an open bottom, a shaft carried by said casing, a set of spaced wheels mounted on said shaft for supporting said casing on the bottom of a pool, brushes provided between said wheels for sweeping material from the bottom of the pool into the open bottom of the casing as said cleaner device moves along the bottom of the pool, an axial turbine having a rotor, a reducing and transmitting mechanism between said rotor and said shaft, the interior of said casing being divided into two compartments by a partition wall delimiting a water inlet to said axial turbine, a first one of said two compartments in said casing being positioned downstream of said axial turbine and being adapted to be connected to said tube, rotation of said rotor due to the flow of water through said axial turbine driving said shaft through said reducing and transmitting mechanism to rotate said wheels thereby to effect movement of said cleaner device along the bottom of the pool, a buoyancy member connected to said casing for maintaining said casing in a substantially vertical position on the bottom of the pool when said cleaner device is immersed in the pool.

2. A device as set forth in claim 1, wherein a strainer is placed in said casing upstream of said inlet for said axial turbine.

3. A device as set forth in claim 2, wherein said strainer is shaped substantially like a second one of said two compartments, said strainer being carried by a plate which forms a cover for said second compartment.

4. A device as set forth in claim 2, wherein said strainer includes a removable bottom member giving access to an inner cavity formed by said strainer.

5. A device as set forth in claim 2, wherein said strainer comprises a front surface obturating a bottom portion of said casing, said front surface carrying a flap valve.

6. A device as set forth in claim 2, wherein said strainer is shaped substantially like one of said two compartments of said casing, said strainer being mounted in said casing and in a cover which is encased on one lateral side of said casing, said strainer and cover forming a removable assembly.

7. A device as set forth in claim 6, wherein said open bottom of the casing is provided with baffle members that form inlet ducts leading to flap-valves opening into said strainer.

8. A device as set forth in claim 2, wherein said strainer comprises a bottom portion which closes the open bottom of said casing and a partition located above said bottom portion to delimit a channel closed at one end by a lateral wall of said strainer, said channel opening in a cover that closes one lateral side of said casing containing said strainer, said bottom portion of said strainer further comprising at least one flap valve for the passage of water through said channel, through said cover, through said strainer, through said turbine and through said tube toward said pump.

9. A device as set forth in claim 8, wherein said partition is U-shaped and joined in one piece with said bottom portion of said strainer.

10. A device as set forth in claim 1, wherein said brushes comprise a sweeping unit that engages the bottom of the pool simultaneously with said wheels.

11. A device as set forth in claim 10, wherein said sweeping unit is loosely mounted on said casing.

12. A device as set forth in claim 10, wherein said sweeping unit is provided with small rods one of said small rods being inserted with some clearance in a notch of a wall of said casing, and another one of said small rods being connected by fingers engaged with some clearance in other notches of said casing, said fingers being retained by a cover for said casing.

13. A device as set forth in claim 1, wherein said wheels comprise two wheels respectively located on opposite sides of said casing.

14. A device as set forth in claim 13, wherein said wheels include a third wheel located at a median part of said shaft.

15. A device as set forth in claim 14, wherein said third wheel has a smaller diameter than said tub wheels.

16. A device as set forth in claim 1, wherein said axial turbine comprises a stator with directing blades placed within a body that is frictionally engaged in a sheath carried by said partition wall.

17. A device as set forth in claim 16, wherein a notch is formed in said sheath containing said body of said axial turbine for use in disassembling said turbine.

18. A device as set forth in claim 16, wherein said stator, said rotor and said sheath are mounted in a sleeve encased in a lateral side of said casing and in a cover containing said reducing and transmitting mechanism, said sleeve and cover forming an interchangeable unit.

19. A device as set forth in claim 1, wherein said axial turbine comprises a stator located upstream of said rotor relative to a circulation direction of water inside said casing, said rotor being mounted on a shaft that drives said reducing and transmitting mechanism, said mechanism being mounted on one side of said casing.

20. A device as set forth in claim 19, wherein said rotor is slidably mounted on said shaft, and wherein a pressure spring is arranged against said rotor, whereby said rotor is movable on said shaft as a function of a pressure applied to said rotor by water drawn by said pump while providing a variable by pass gap between said stator and rotor.

21. A device as set forth in claim 20, wherein said rotor is freely mounted for rotation on said shaft, wherein said spring is a helical spring engaged on said shaft, and wherein ends of said spring are fixed, on the one hand, to the rotor and, on the other hand, to a sleeve connected to said reducing and transmitting mechanism.

22. A device as set forth in claim 1, wherein an adjusting flap valve is arranged in said partition wall for bypassing a vacuum formed by said pump.

23. A device as set forth in claim 1, wherein said casing is connected to said tube by a connection member that allows rotation of said casing with respect to said tube.

24. A device as set forth in claim 1, wherein said buoyancy member maintains said casing in a position in which at least one of said brushes bears on the bottom of said pool.

25. A device as set forth in claim 1, wherein said buoyancy member is mounted on said tube leading to said pump.

26. A device as set forth in claim 1, wherein said tube is mounted on said buoyancy member by frictionally connecting elements of resilient material that extend from said buoyancy member into notches of said tube.

* * * * *